US007402129B2

(12) United States Patent
Diehr

(10) Patent No.: US 7,402,129 B2
(45) Date of Patent: Jul. 22, 2008

(54) FOLDING-BOX GLUING MACHINE FOR PRODUCING FOLDING BOXES FROM BLANKS

(75) Inventor: Wolfgang Diehr, Grevenbroich (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 172 days.

(21) Appl. No.: 11/110,398

(22) Filed: Apr. 20, 2005

(65) Prior Publication Data

US 2005/0250635 A1 Nov. 10, 2005

(30) Foreign Application Priority Data

May 4, 2004 (DE) ..... 10 2004 022 217.7

(51) Int. Cl.
*B31B 1/26* (2006.01)

(52) U.S. Cl. ..... 493/79; 493/51; 493/478; 493/128

(58) Field of Classification Search ..... 493/79, 493/34, 51, 478, 52, 128, 151
See application file for complete search history.

(56) References Cited

U.S. PATENT DOCUMENTS 3,961,781 A * 6/1976 Funk ..... 493/13
4,012,996 A * 3/1977 Stolkin et al. ..... 493/142
4,169,406 A 10/1979 Tanham
4,262,582 A 4/1981 Sugimoto et al.
4,405,304 A * 9/1983 Bensberg et al. ..... 493/476
4,565,048 A * 1/1986 Lade ..... 53/201
4,604,083 A * 8/1986 Barny et al. ..... 493/34
4,847,775 A * 7/1989 Roch et al. ..... 700/125
5,104,365 A * 4/1992 Sone et al. ..... 493/1
5,168,453 A * 12/1992 Nomaru et al. ..... 700/114
5,316,123 A 5/1994 Achelpohl
5,435,360 A * 7/1995 Mott ..... 144/356
5,528,487 A * 6/1996 Adachi et al. ..... 700/57
5,660,262 A 8/1997 Landrum et al.
6,126,383 A 10/2000 Franklin et al.
6,164,431 A 12/2000 Morisod
6,827,678 B1 * 12/2004 Kumpel ..... 493/34

FOREIGN PATENT DOCUMENTS

DE 26 54 641 A1 8/1978
DE 34 28 419 A1 2/1985
DE 40 36 627 A1 5/1992
DE 42 42 824 A1 6/1994

(Continued)

*Primary Examiner*—Sameh H. Tawfik
(74) *Attorney, Agent, or Firm*—Laurence A. Greenberg; Werner H. Stemer; Ralph E. Locher

(57) ABSTRACT

A machine for folding and gluing folding boxes has a first folding station and at least one second folding station that follows downstream. Machine components are provided which can be positioned transversely and which contain conveying elements for blanks for the folding boxes and at least one adhesive application unit. The machine further has actuating drives for positioning the machine components, and a rotary station which is disposed downstream of the first folding station and upstream of the second folding station. The rotary station has a fixedly disposed transport device for the blanks. A controller controls the actuating drives of the machine components which are provided in front of and behind the rotary station and which can be positioned transversely, as a function of the type of folding boxes that is to be produced.

1 Claim, 3 Drawing Sheets

FOREIGN PATENT DOCUMENTS

| | | | |
|---|---|---|---|
| DE | 197 01 345 | A1 | 7/1998 |
| DE | 698 00 233 | T2 | 12/1998 |
| DE | 198 03 820 | A1 | 8/1999 |
| DE | 100 43 991 | A1 | 4/2000 |
| EP | 0 486 043 | A1 | 5/1992 |
| EP | 0 881 173 | A1 | 12/1998 |
| GB | 2 144 368 | A | 3/1985 |
| WO | WO 02/20382 | A1 | 3/2002 |

* cited by examiner

FOLDING-BOX GLUING MACHINE FOR PRODUCING FOLDING BOXES FROM BLANKS

BACKGROUND OF THE INVENTION

Field of the Invention

The invention relates to a folding-box gluing machine for producing folding boxes from blanks.

In order to produce even complicated box shapes at high speeds, it is known from European Patent EP 0 881 137 B1 (corresponding to U.S. Pat. No. 6,164,431) to dispose a processing station in the form of a rotary station within a folding-box gluing machine, which rotary station turns the blanks which are lying flat after a first folding station by 90° about an axis which is perpendicular to the conveying plane. Further possible processing stations are one or more aligning stations, in which the blanks are laterally aligned exactly after being removed from a feeder or after a processing station, one or more pre-breakers in which the folding tabs are folded forward and backward, in order that the corresponding groove lines are made soft and flexible by being bent by 180°, and also stations for special folding operations or other processing operations. At the beginning of a folding station, an application unit for adhesive is usually disposed, which application unit applies an adhesive strip onto the folding tabs which are to be glued.

Narrow belt conveyors are predominantly used as conveying elements for transporting the blanks through the individual stations, it being necessary to adjust the belt conveyors, in the same way as application units for adhesive and further processing elements, in each case, before production begins, into a transverse position which depends on the type of blank. In addition, the conveying elements of the rotary station have to be oriented with respect to the centroid of the blank; for this reason, the conveying elements of the rotary station which is known from European Patent EP 0 881 137 B1 are mounted so as to be adjustable transversely with respect to the conveying direction.

Furthermore, it is known from European Patent EP 0 881 137 B1 (corresponding to U.S. Pat. No. 6,164,431) not to configure the frame of the rotary station to be transversely adjustable, but to displace the conveying elements of the following folding and gluing apparatus laterally. The method requires increased setting expenditure, as it is also necessary to reset the following processing stations again in the event of every change to the setting of a processing station. Published, non-prosecuted German patent application DE 198 03 820 A1 (corresponding to U.S. Pat. No. 6,827,678) discloses a folding-box gluing machine which has an automatic format setting device, by which machine components for processing and/or conveying the blanks can be adjusted automatically into corresponding transverse positions. The machine contains a control computer with a memory for the set-point positions, which control computer controls mechanism motors that position the machine components.

SUMMARY OF THE INVENTION

It is accordingly an object of the invention to provide a folding-box gluing machine for producing folding boxes from blanks which overcomes the above-mentioned disadvantages of the prior art devices of this general type, which makes rapid automatic format setting possible to a multiplicity of box blanks of different configurations, which automatic format setting is as simple as possible in structural terms.

With the foregoing and other objects in view there is provided, in accordance with the invention, a machine for folding and gluing folding boxes. The machine contains a first folding station, at least one second folding station disposed downstream of the first folding station, and machine components positioned transversely along the machine. The machine components contain conveying elements for blanks for the folding boxes and at least one adhesive application unit. Actuating drives are provided for positioning the machine components. A rotary station is disposed downstream of the first folding station and upstream of the second folding station. The rotary station has a fixedly disposed transport device for the blanks. A controller which, in a coupled manner, in each case controls the actuating drives of the machine components disposed in front of and behind the rotary station and the machine components being positioned transversely, in dependence of a type of folding box to be produced.

The solution has the advantage that, after the modules have been pre-positioned in the set-up mode, it is then possible to carry out speed-dependent changes, which require readjustment of the modules, on coupled modules. It is thus possible to carry out the speed-dependent change by a displacement with a common value for the modules in front of and behind the rotary station. Complicated individual displacement of the modules has thus been rendered superfluous.

Furthermore, the solution has the advantage that the conveying elements of the rotary station do not require any dedicated transverse displacement mechanism, but positioning is carried out exclusively via transverse displacement mechanisms in upstream and downstream processing stations. Additionally, the positioning range and therefore the spectrum of processable blank types are very large. In particular in the case of complicated blanks with pronounced differences in length and width, positioning takes places very rapidly.

Other features which are considered as characteristic for the invention are set forth in the appended claims.

Although the invention is illustrated and described herein as embodied in a folding-box gluing machine for producing folding boxes from blanks, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
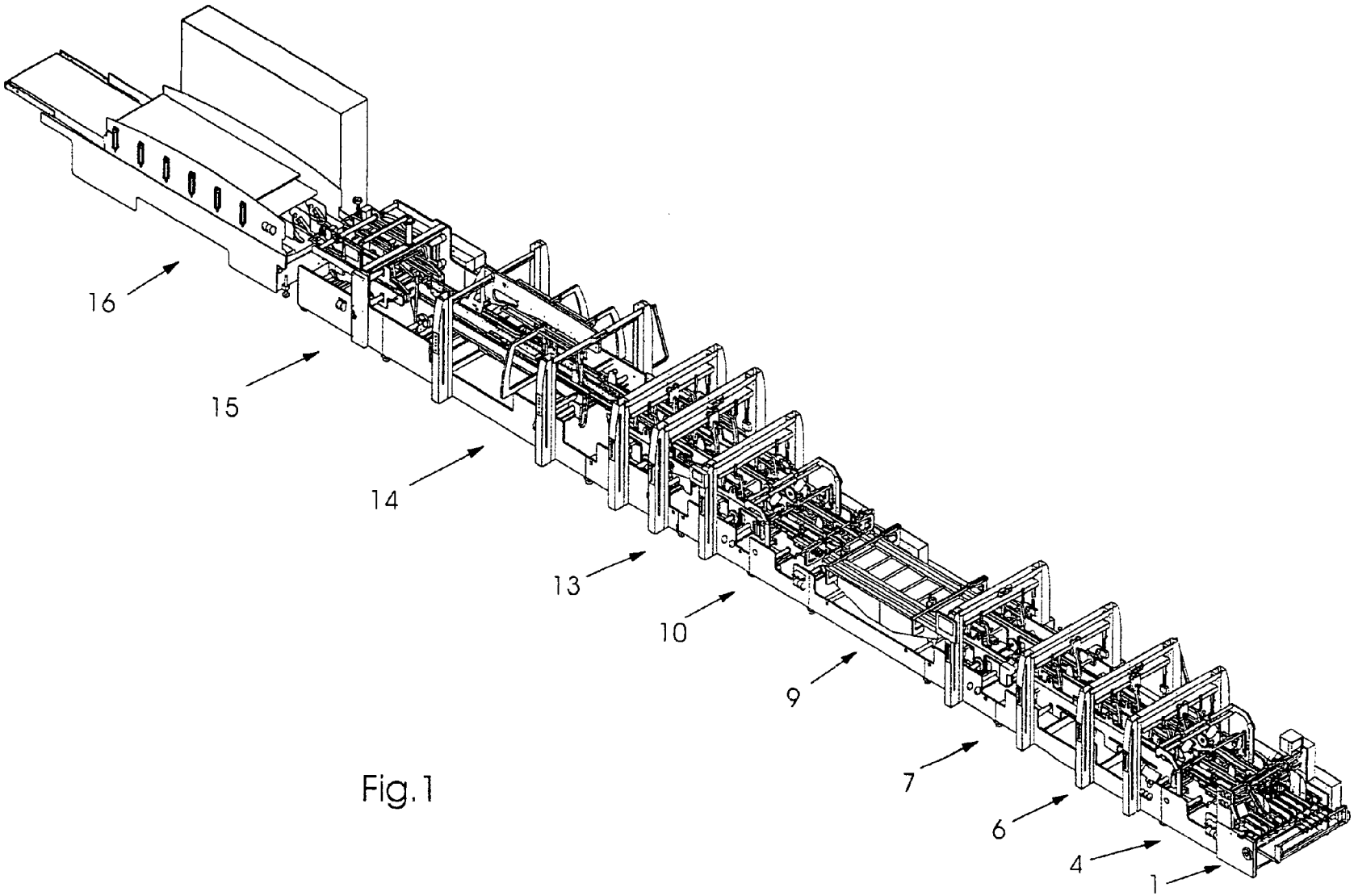
FIG. 1 is a diagrammatic, perspective view of individual processing stations of a folding-box gluing machine according to the invention.
Figure 2:
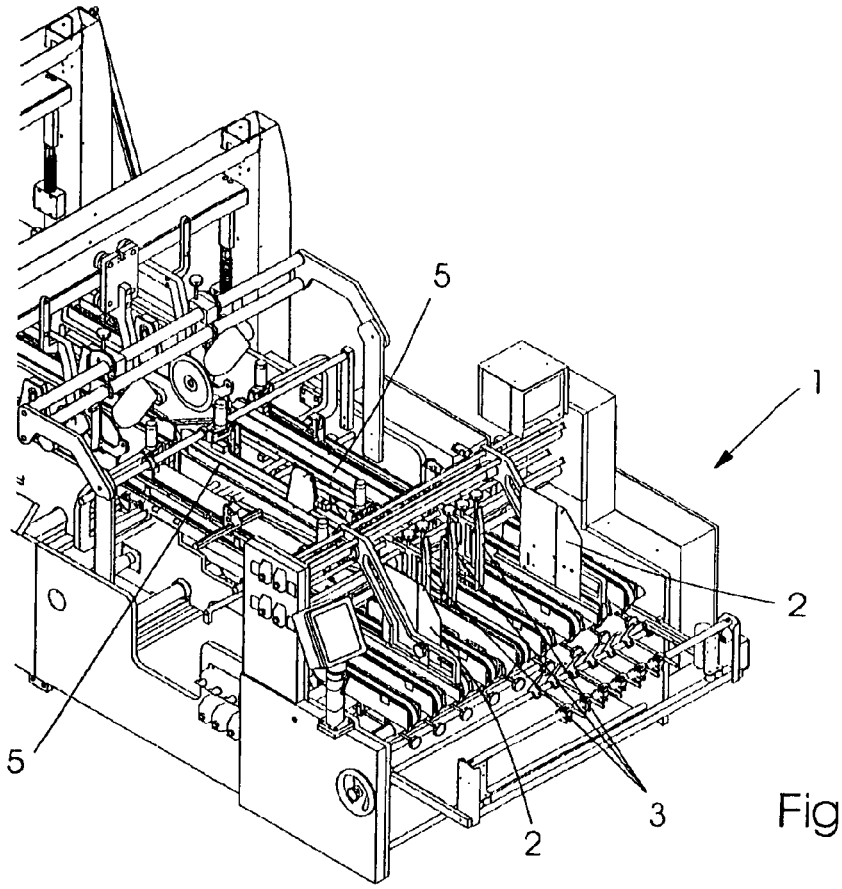
FIG. 2 is a diagrammatic, partial perspective view of a feeder with a following aligning station.

Referring now to the figures of the drawing in detail and first, particularly, to FIG. 1 thereof, there is shown at the lower right corner, a folding-box gluing machine beginning with a feeder 1 which pulls the blanks to be processed from a stack at high speed one after another and feeds them individually to the following processing station. The feeder 1 contains machine components in the form of lateral stack walls 2 and adjusting tongues 3 which are positioned transversely by an actuating drive, in a manner that is dependent on the type of blank (FIG. 2).

The feeder 1 is followed in an adjoining manner by an aligning station 4 in that the blanks are aligned individually against a lateral stop. Machine components that can be positioned transversely in the form of two pairs of belts 5 pass through the aligning station 4, which machine components serve as conveying elements and can be positioned transversely via actuating drives. The feeder 1 and the aligning station 4 are shown in FIG. 2 on an enlarged scale.

Figure 3:
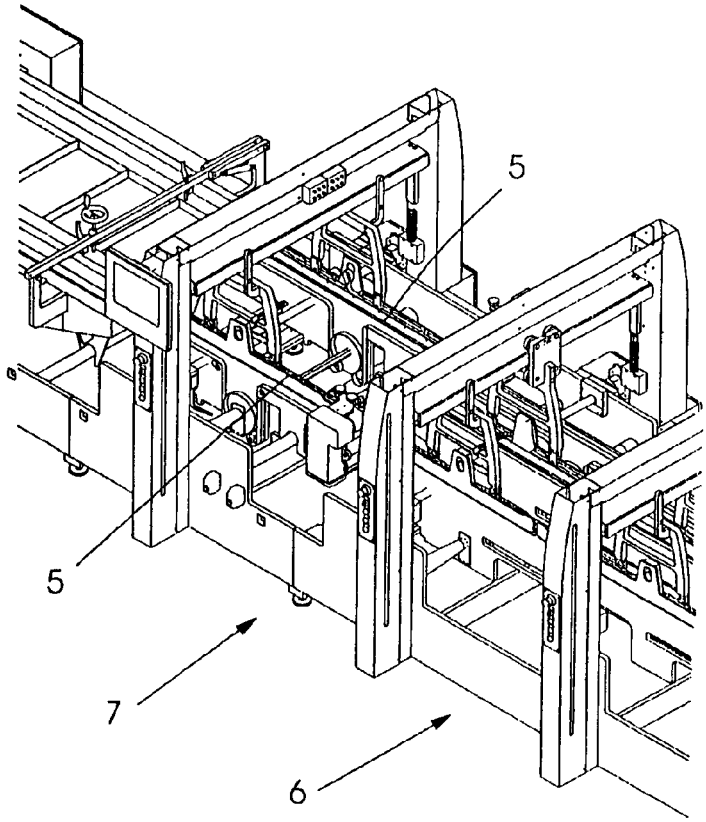
FIG. 3 is a diagrammatic, partial perspective view of a part of the machine with a pre-breaker and a following folding station.

Subsequently, a pre-breaker 6 and a first folding station 7 follow, which are shown in FIG. 3. Machine components which can be positioned transversely pass through both the pre-breaker 6 and the folding station 7, the machine components being in the form of pairs of belts 5 as conveying elements which are positioned transversely with an actuating drive, in a manner which is dependent on the type of blank. Disposed at the beginning of the folding station 7 is a machine component that can be positioned transversely, in the form of an adhesive application unit that is likewise positioned transversely with an actuating drive, in order that an adhesive strip is applied onto the folding tab that is to be glued. The folding elements of the folding station 7 (folding belts, etc.) are connected fixedly to the pair of belts 5 and are thus positioned with the latter.

Figure 4:
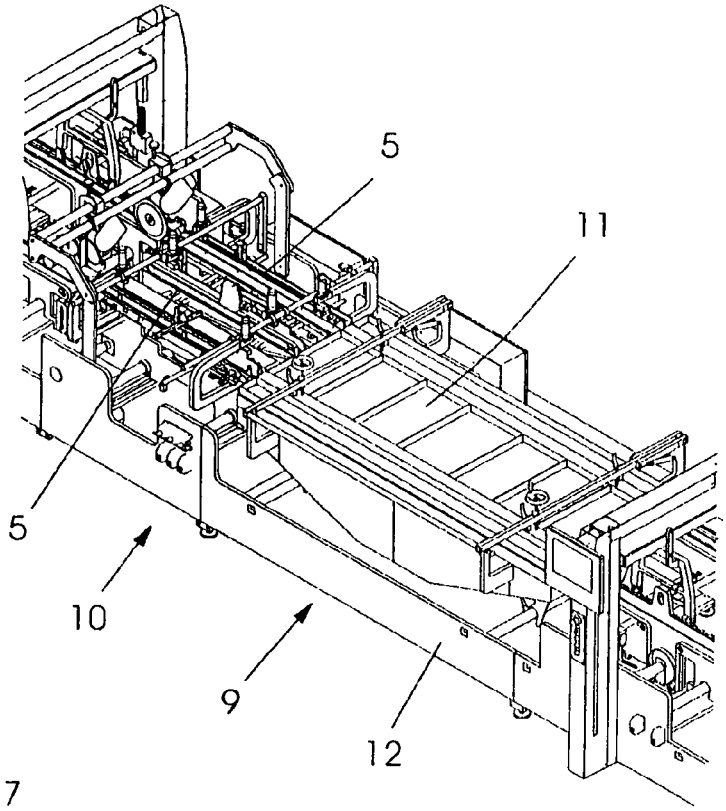
FIG. 4 is a diagrammatic, partial perspective view of a rotary station with a following aligning station.
Figure 5:
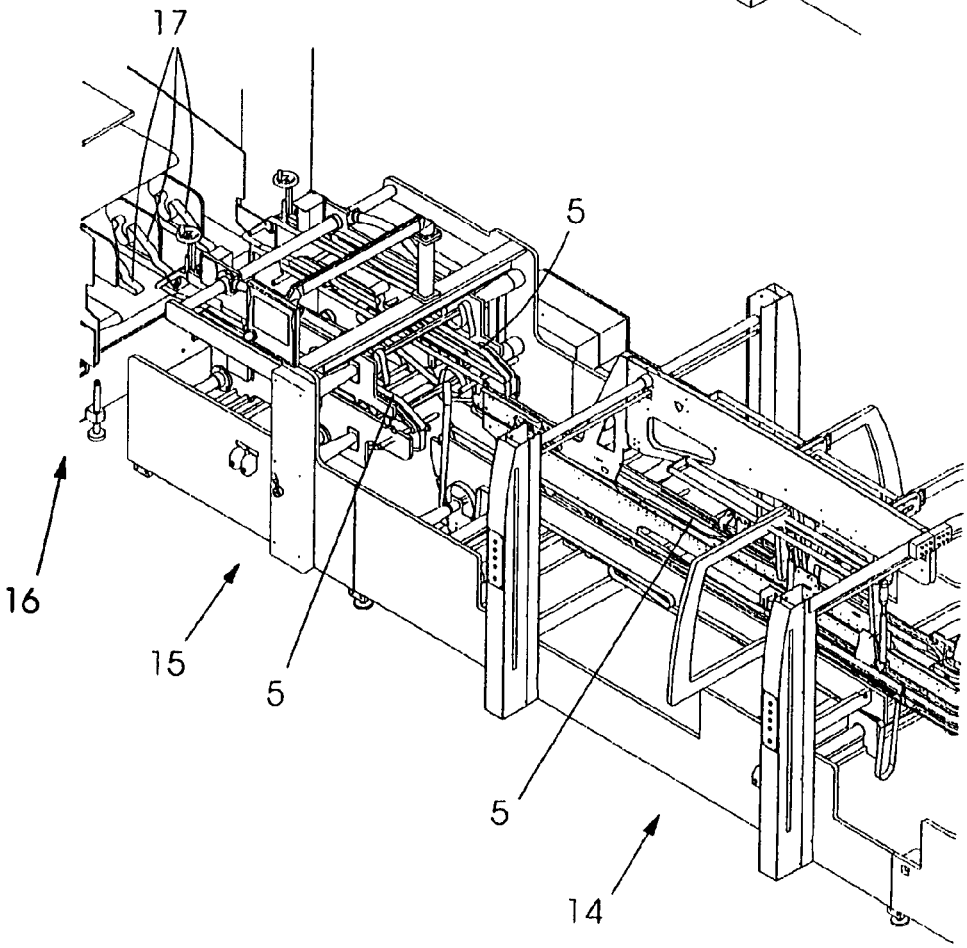
FIG. 5 is a diagrammatic, partial perspective view of a further folding station with a transfer station and the beginning of a collecting and pressing device.

The folding station 7 is followed by a rotary station 9 that is shown in FIG. 4 with a following further aligning station 10. In order to rotate the blanks about a perpendicular axis by 90°, the rotary station 9 contains two conveying sections which are disposed parallel next to one another and whose speed can be set separately. The blanks lie on both conveying sections, with the result that they are rotated in the event of different speeds for the two conveying sections. The two conveying sections contain driven rolls as conveying elements. In order to prevent the blank parts which have already been folded from opening, they are held down during their passage through the rotary station 9 by a plate-shaped hold-down 11 which is pivoted parallel to the conveying plane in its operating position in FIG. 1 and FIG. 4 and thus covers the two conveying sections. The conveying rolls of the two conveying sections of the rotary station 9 are mounted fixedly in terms of position and non-displaceably in their frame 12. They therefore always remain in the same position, irrespective of the type of blank.

The rotary station 9 is followed in an adjoining manner by a further aligning station 10 that corresponds in its construction to the aligning station behind the feeder 1. It thus again contains machine components that can be positioned transversely, in the form of pairs of conveying belts 5 as conveying elements.

The next processing station 13 serves to carry out processing operations which are dependent on the type of blank; for example, further groove lines are pre-broken or special folding operations are carried out. The pairs of belts 5 also pass through the processing station 13, as conveying elements that can be positioned transversely with actuating drives.

A second folding station 14 then follows, in which blank parts which have previously been provided with an adhesive seam are folded over by 180°. The second folding station 14 also contains pairs of belts 5 as conveying elements and an adhesive application unit, which can be moved by actuating drives into their transverse position which depends on the type of blank. A transfer station 15 then follows, by which the folded blanks, which are provided with adhesive seams which have not yet been set, are fed to the following collecting and pressing device 16, with all parts aligned exactly. In the collecting and pressing device 16, an overlapping stream of folded blanks is initially formed, which overlapping stream is subsequently held for some time under pressure between conveying pressing belts, in order that the adhesive seams set. The transfer station 15 likewise contains pairs of belts 5 which can be displaced transversely by actuating drives. Three short belt conveyors 17 are disposed at a spacing next to one another at the inlet of the collecting and pressing device 16, which belt conveyors 17 can likewise be positioned transversely with an actuating drive.

The folding-box gluing machine contains a control device which controls the actuating drives of the conveying elements, adhesive application units and further machine components which contain processing devices which are to be positioned transversely, in order for them to assume predetermined positions. The machine components are coupled electronically via the controller and are positioned as a function of the box type which is to be produced, while the conveying elements of the rotary station 9 remain fixed in position, that is to say are not displaced.

The folding-box gluing machine is preferably set according to the following method: initially, all the machine components which are situated in front of the rotary station 9 and which can be positioned transversely are pre-positioned by the control device in stored positions relative to one another which are dependent on the box type and format. The machine components which are situated behind the rotary station 9 and which can be positioned transversely are subjected to identical pre-positioning relative to one another. For an exact rotation in the rotary station 9, it is necessary for the centroid of the blanks to move along the center line between the two conveying sections as far as possible. Therefore, after they have been pre-positioned relative to one another, the machine components in front of the rotary station 9 which can be positioned transversely are displaced in parallel in a coupled manner and at a constant spacing relative to one another, until the centroid line of the conveying section is aligned with the center line of the rotary station 9. In the same way, the machine components that are situated behind the rotary station 9 and which can be positioned transversely are displaced transversely in a coupled manner, until they are likewise aligned with the center line of the rotary station 9.

This application claims the priority, under 35 U.S.C. § 119, of German patent application No. 10 2004 022 217.7, filed May 4, 2004; the entire disclosure of the prior application is herewith incorporated by reference.

I claim:

1. A machine for folding and gluing folding boxes, the machine comprising:

a first folding station;

at least one second folding station disposed downstream of said first folding station;

machine components positioned transversely with respect to a conveying direction of the boxes along the machine, said machine components containing conveying elements for blanks for the folding boxes and at least one adhesive application unit;

actuating drives for positioning said machine components;

a rotary station disposed downstream of said first folding station and upstream of said second folding station, said rotary station having a fixedly disposed transport device for the blanks; and a controller which, in a coupled manner, in each case controls said actuating drives of said machine components disposed in front of and behind said rotary station and said machine components being positioned transversely with respect to the conveying direction, in dependence of a type of folding box to be produced.

* * * * *